US005327588A

United States Patent [19]

Garneau

[11] Patent Number: 5,327,588

[45] Date of Patent: Jul. 12, 1994

[54] SAFETY HELMET FOR CYCLISTS

[76] Inventor: Louis Garneau, 246 chemin de la Butte, St-Augustin de Desmaures Quéec, Canada, G3A 2E6

[21] Appl. No.: 136,941

[22] Filed: Oct. 18, 1993

[51] Int. Cl.[5] ..... A42B 3/02

[52] U.S. Cl. ..... 2/422; 2/209.13; 2/918; 362/105

[58] Field of Search ..... 2/422, 209.13, 912, 2/918, 209.14, 410, 425, 424; 362/105, 106, 103, 72; 446/27

[56] References Cited

U.S. PATENT DOCUMENTS

| | | | |
|---|---|---|---|
| 2,788,439 | 4/1957 | Hesse . | |
| 3,765,031 | 10/1973 | Beresic | 2/422 X |
| 4,186,429 | 1/1980 | Johnston . | |
| 4,559,586 | 12/1985 | Slarve | 362/106 |
| 4,638,410 | 1/1987 | Barker | 362/105 |
| 4,891,736 | 1/1990 | Gouda | 362/105 |
| 4,901,210 | 2/1990 | Hanabusa . | |
| 5,177,812 | 1/1993 | Demars | 362/205 X |

FOREIGN PATENT DOCUMENTS

| | | | |
|---|---|---|---|
| 1401264 | 4/1965 | France | 362/106 |

*Primary Examiner*—Peter Nerbun

*Attorney, Agent, or Firm*—Pierre Lespérance; Francois Martineau

[57] ABSTRACT

A safety helmet is of the streamlined, aerodynamically contoured type, to provide enhanced performance at high speeds. The aft lower end portion of the helmet external shell includes a cavity, this cavity receiving a light-emitting device with self-enclosed power pack. The light device is releasably anchored into the shell cavity by hook and loop fasteners. The light device is sized to substantially fully fill and complementarily fit inside the cavity, in such a way that the exterior face of the light device becomes generally coextensive to the exterior face of the helmet contoured external shell, whereby the aerodynamic features of the helmet are not compromised. Access to the shell cavity from the shell interior face is enabled by two finger-engageable through-bores. The light device can be released from the shell cavity by pushing same with the cyclist's fingers through said through-bores.

6 Claims, 2 Drawing Sheets

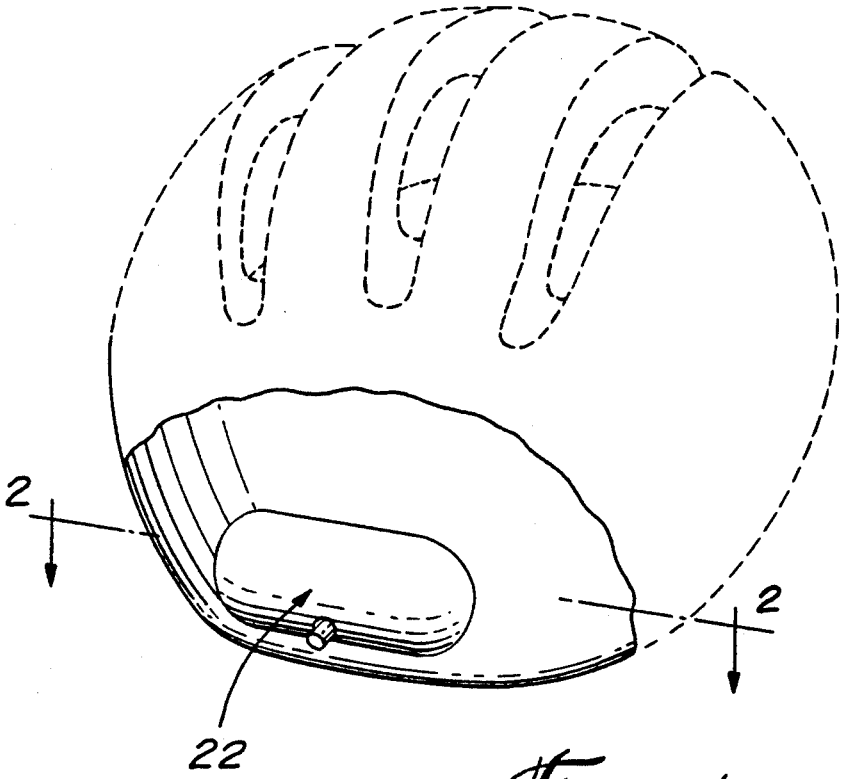
Fig. 1
Fig. 2
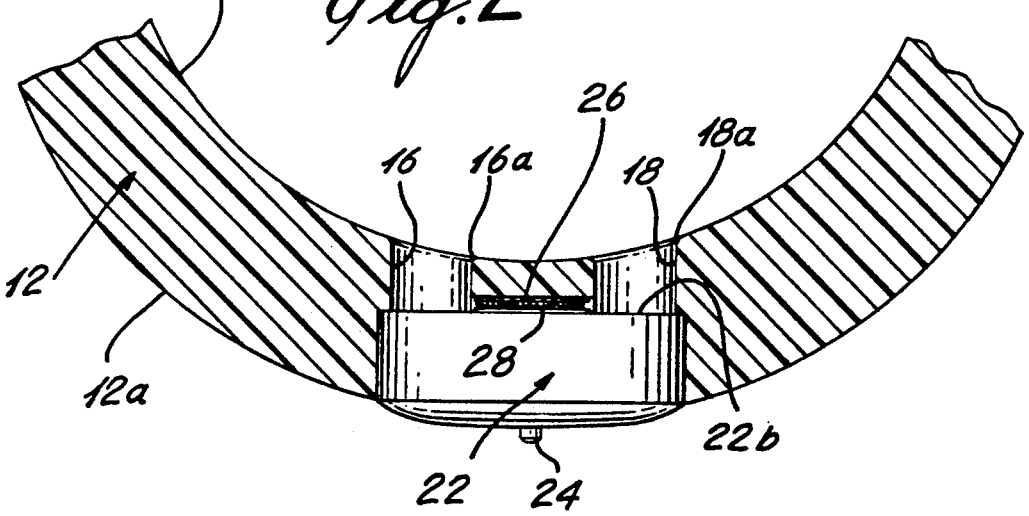

Fig. 3
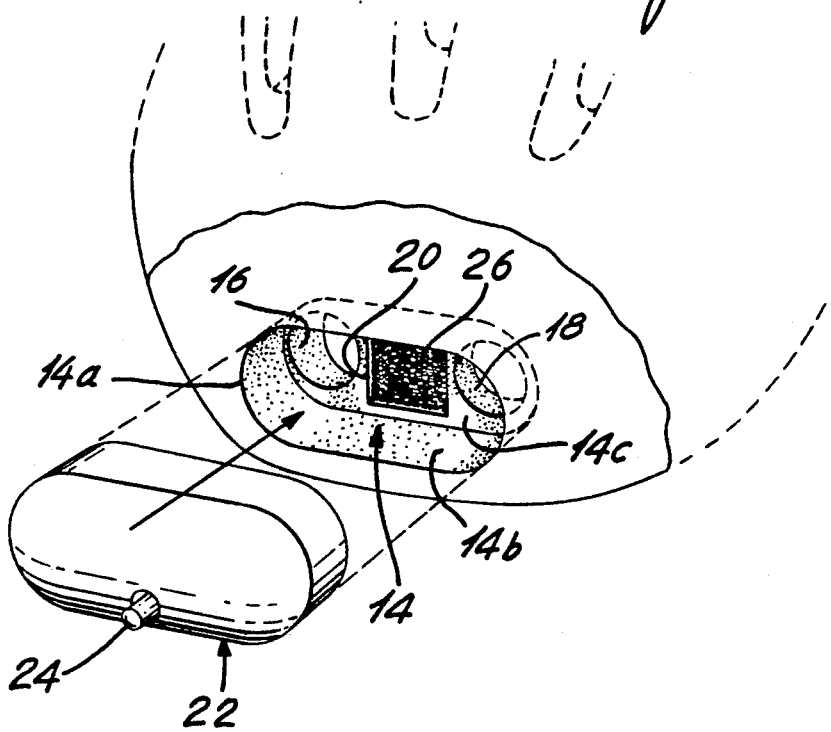
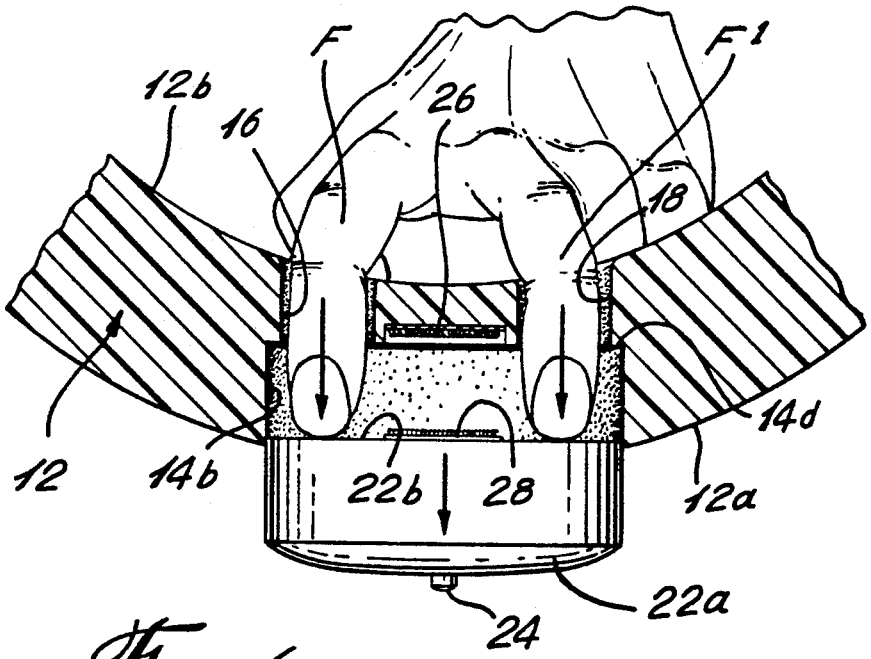
Fig. 4

SAFETY HELMET FOR CYCLISTS

FIELD OF THE INVENTION

This invention relates to safety helmets used by cyclists, particularly those using person-powered bicycles.

BACKGROUND OF THE INVENTION

The helmet of a road-going cyclist or motorcyclist is a very important safety component, in that it shields the user's head from impact injury. Such head impact injury is usually a consequence of lateral tilting (falling) to the ground of the bicycle or motorcycle in motion. Indeed, as is well known by those familiar with such vehicles, the lateral stability thereof is dynamically enabled—i.e., it is because the vehicle is in forward motion that it can remain upright without falling laterally to the ground. See for example U.S. Pat. No. 5,231,703 issued Aug. 3, 1993 to the present inventor.

It has also been discovered in the field that, for (non-powered, i.e. person-pedalling) bicycles at least, the contour or shape of the helmet does have an influence on the performance of the vehicle, particularly with respect to the top speed that can be achieved with the vehicle, the lateral wind sensitivity values, and generally speaking the power output that can be efficiently delivered. This is because, as bicycle speed increases, helmet-induced aerodynamic drag also increases.

A quick review of basic notions of aerodynamics would not be irrelevant. Aerodynamics is the branch of dynamics that treats of the motion of air and other gaseous fluids and of the forces acting on solids in motion relative to such fluids. When an airfoil is moved at subsonic speeds through the air, the motion produces a pressure at every point of the airfoil which acts orthogonally to the surface. In addition, a frictional force tangential to the surface opposes the motion. The sum of these pressure and frictional forces gives the resultant force acting on the airfoil.

Drag D, or resistance on an airfoil wing, can be defined by the following formula:

$$D = C_D \tfrac{1}{2} \rho V^2 S$$

where:

$C_D$ is the wing chord;

$\rho$ is the density or air;

V is the apparent air velocity; and

S is the wing area.

Therefore, it can be readily understood that drag is a function of the square of the relative wind velocity V, as well as a function of the wing area. Thus, a small increase in (head) wind speed translates into a much greater increase of the wind-induced resistance to motion.

With these teachings in mind, bicycle helmet designers have developed the current state of the art bicycle helmets in such a way as to streamline same to approximate the contour of an airfoil. Hence, airfoil aerodynamic designs have been extended to apply to bicycle helmets. Therefore, it can now be understood that a small incremental increase in head wind for the cyclist will translate into a correspondingly much greater incremental increase in drag, which is to say, a much greater pedalling effort will be required from the cyclist for a given speed and a much lower top speed value would normally be achieved for a given power output. Since the power output of a cyclist is usually quite small—about ¼ to ½ horsepower (approximately 180 to 360 Watts) at peak output—head wind speed will have a considerable effect on the speed of the bicycle.

It is to be remembered also that, for the so-called high-speed bicycles with the handsets being offset at a point of the bicycle much ahead and quite low, the cyclist must take a position whereby the head becomes the frontmost part of his body. That is, the cyclist head becomes the leading edge of the cyclist body, much like the leading edge of an airfoil wing. Hence, the contour of this leading edge helmet becomes a significant component in the performance-enhancing equipment of cyclist's gear.

Empirical on-the-field studies have shown time and again that such helmet streamlining does provide significant performance enhancement of bicycle performance.

Clearly therefore, any bulk part projecting orthogonally from the helmet would considerably affect the aerodynamic drag thereof, by inducing turbulence which would significantly increase the drag. Indeed, such bulk part would increase the "wing chord" and/or the "wing area" of the helmet, and would therefore increase drag D in the above-noted formula as parameters C and S.

A third feature of helmets have been their modifications to act as a template for receiving and supporting a visual warning device for alerting motorists of the presence of the cyclist on the road during non-daylight periods. U.S. Pat. No. 4,186,429 issued Jan. 29, 1980 to Walter JOHNSTON discloses such a helmet 12 being provided with a light 30 secured by its plastic base 16 to the top portion of the helmet by a rubber cup 14. As clearly seen in FIG. 1, this light and base assembly 30, 16, projects orthogonally from the helmet; and the helmet is not of the streamlined, airfoil type, but rather, of an old-design, dome type. There is also envisioned that the light be powered autonomously by a battery pack carried on the cycle or by the cyclist.

More recent U.S. Pat. No. 4,901,210 issued Feb. 13, 1990 to Akira HANABUSA, discloses a dome-shaped motorcycle helmet with a warning light carried at the aft end of the helmet. In one embodiment—FIG. 11—, hook and loop fasteners (sold under the registered trademark VELCRO) are envisioned to be used as securing means for securing the light support member to the helmet frame. In another embodiment—FIG. 15—, holes are made through the helmet to receive bolts, said bolts to secure the light to the helmet. This light is claimed to be entirely self-contained, carrying its own power source; as well as to be detachable from the helmet in the event of an accident, to prevent it from snagging the helmet and causing injury to the wearer.

U.S. Pat. No. 2,788,439 issued in 1957 to Gilbert HESSE (from St-Calixte, Québec) is another example of such light warning device, but here for use over a soft fabric, hunter-type hat (as per the safety pin 2 that is to pierce the hat).

A fourth consideration in bicycle helmet construction is the aesthetic design thereof. More and more, helmets do tend to convey a sense of visual appeal that promotes their sale and their use, as their above-noted functional features, although paramount, do not exclude aesthetic qualities. Clearly, a bicycle helmet which has a non-aesthetic appearance will not sell well, or else, if purchased, may not be worn. Indeed, those persons most likely to benefit from such helmets, namely children and teenagers, will likely be induced not to wear them if they feel in any way that they will look silly, due to the strong peer pressure at that age "not to look like a nerd". Hence, for such reasons, owning an helmet but not wearing it is no doubt a greater safety hazard, because it can bring a false sense of security. This is where the design and the utility parts of the patent protection effectively merge together.

OBJECTS OF THE INVENTION

The gist of the invention is therefore to address the road-safety needs of modern cyclists during non-daylight periods.

An important object of the invention is to provide a helmet-mounted visual warning device for cyclists, which will not significantly affect the helmet aerodynamic contour.

A corollary object of the invention is to promote the frequent use of the helmet—and thus increase its safety aspect—due to its eye appealing design.

Another corollary object of the invention is that the helmet-mounted visual warning device remain attached to the helmet upon the helmet sustaining an impact blow, whereby the visual warning device, by not detaching from the helmet, will not ballistically impact the cyclist as to constitute a safety hazard.

SUMMARY OF THE INVENTION

Accordingly with the objects of the invention, there is disclosed a safety helmet for a cyclist, including a shell of arcuate exterior contour, at least the external part of said shell being a hard shell part, the interior part of said shell circumscribing an open enclosure to conformingly fit the head of the cyclist, a cavity being made into said hard external shell part and defining a mouth opening exteriorly of said helmet, a light member releasably engaged into said cavity through said mouth, means for releasably anchoring said light member inside said cavity, and means for releasing said light member from said cavity; wherein said light member defines an exterior face substantially coextensive to and generally matching the radius of curvature of the arcuately contoured said hard external shell part.

Preferably, said hard external shell part is of aerodynamic design, and said light member filling substantially fully the volume of said cavity.

Advantageously, said cavity defines an interior floor, said means for releasably anchoring said light member inside said cavity consisting of a hook and loop assembly including a first hook band and a second loop band, one of said bands being anchored to said cavity interior floor while the other of said bands being anchored to said light member, whereby by seating said light member against said cavity interior floor, said hook and loop assembly becomes operative.

Profitably, said means for releasably anchoring said light member inside said cavity includes at least one through-bore, said through-bore being diametrally smaller than said cavity and extending through said shell and opening at its exterior end into said cavity and at its interior end into said shell interior open enclosure, said through-bore being sized for free through-engagement by a finger from the cyclist; whereby said cyclist, upon removing his helmet from his head, can access with one finger the interior part of said light member inside said cavity and push said light member outwardly from said cavity, said means for releasably anchoring said light member inside said cavity being automatically inactivated by such pushing action of said finger.

Said light member could include a self-enclosed power pack, said power pack being engaged or disengaged by a small on/off push-button projecting exteriorly therefrom, radially outwardly from said outer shell.

Alternately, said cavity could define an elongated interior floor, said means for releasably anchoring said light member inside said cavity consisting of a hook and loop assembly including a first hook band and a second loop band, one of said bands being anchored to said cavity interior floor while the other of said bands being anchored to said light member, whereby by seating said light member against said cavity interior floor, said hook and loop assembly becomes operative; and said means for releasably anchoring said light member inside said cavity including a pair of through-bore, each said through-bore being diametrally smaller than said cavity and extending through said shell and opening at its exterior end into two opposite ends of said cavity elongated interior floor and at its interior end into said shell interior open enclosure, said through-bores being sized for free through-engagement by two fingers from the cyclist; whereby said cyclist, upon removing his helmet from his head, can access with his two fingers the interior part of said light member inside said cavity and push said light member outwardly from said cavity, said hook and loop fastening bands being automatically released from one another by such pushing action of said fingers.

BRIEF DESCRIPTION OF THE DRAWINGS

FIG. 1 is a perspective view of a modern, aerodynamically contoured bicycle helmet, shown mainly in dotted lines, but with its aft lower end portion being shown in full lines with the light member in position inside the shell cavity;

FIG. 2 is an enlarged cross-section taken about line 2—2 of FIG. 1;

FIG. 3 is a view similar to FIG. 1, but with the light member being removed from the shell cavity, and suggesting by the arrow how the light member can be fitted inside the shell cavity; and FIG. 4 is a view similar to FIG. 2, suggesting by the arrows how the light member can be pushed out by the user's fingers and removed from the shell cavity.

DETAILED DESCRIPTION OF THE INVENTION

The streamlined, aerodynamically-contoured cyclist helmet 10, illustrated in FIGS. 1 and 3, is of the conventional, modern type, as already detailed in the Background of the invention paragraph. Helmet 10 defines an arcuate shell 12, at least the exterior portion of which is made from a hard, impact resistant material. FIGS. 2 and 4 suggests that the shell 12 is made from a single homogeneous material, although it should be understood that other variations are envisioned, for example: a helmet with a hard exterior shell part and a soft, impact resistant, interior shell part secured to the exterior shell part. Shell 12 defines an exterior face 12*a* and and an interior face 12*b*.

A cavity 14 is made in a portion of the external shell part of the helmet, preferably the aft lower portion thereof as illustrated in the figures. Cavity 14 may have a variety of shapes, e.g. ovoidal, with its long axis extending generally orthogonally to the long, fore and aft axis of the helmet. Cavity 14 defines a mouth 14*a*, merging with the shell exterior face 12*a*, an ovoidal side wall 14*b*, and an interior floor 14*c*. At least one, and preferably two generally cylindrical through bores, 16, 18, are made through the interior part of the shell 12, opening at their exterior ends into ovoidal cavity 14 at the two opposite ends thereof through floor 14*c*, and each defining at their interior ends a mouth 16*a*, 18*a*, merging with the shell interior face 12*b*. Each bore 16 and 18 is freely engageable by a corresponding finger F, F', from the hand of a cyclist. As best seen in FIG. 4, bores 16 and 18 are not coextensive with the cavity side wall 14*b*, but rather, a small, external annular seat 14*d* is defined diametrally outwardly from the bores 16 and 18. Flooring 14*c* further includes a small, e.g. quadrangular, recess 20, for a purpose later set forth.

A light-emitting device 22 is removably fitted inside cavity 14. Light-emitting device 22 is of any conventional make, for example with a self-enclosed power pack (not illustrated). Device 22 includes a transparent or at least translucent housing, preferably sized to conformingly fit inside cavity 14. Thus, the device 22 may be ovoidal in section, so as to have a shape complementary to that of cavity 14, and convex on its exterior face 22*a*, to form a substantially coextensive surface with the shell exterior face 12*a* when device 22 fully engages cavity 14, and simply flat on its interior face 22*b*. When device 22 is fully engaged into cavity 14, the flat interior face thereof 22*b* flatly abuts against the cavity flooring 14*c*—including the annular seat part 14*d* of the cavity flooring 14*c*; therefore, bores 16 and 18 enable access to two free portions of the device interior face 22*b*, and a third intermediate free portion of interior face 22*b* is defined in register with recess 20.

As clearly illustrated in FIG. 4 and as suggested by the arrows, to release the light housing 22 from the cavity 14, one needs only to insert two fingers through bores 16 and 18, from the inside open enclosure of the helmet 10, whereby the interior face 22*b* of the light housing 22 is reached, and then push this interior face 22*b* to move the light housing 22 outwardly from cavity 14 through exterior mouth 14*a*.

To energize the light-emitting device 22, a conventional on/off push button 24 projecting from the housing thereof can be used. In the preferred embodiment, the push button 24 is located on the convex surface 22*a* of device 22, for example intermediately thereof, and projecting tangentially from the surface 22*a*.

Means are provided to releasably anchor the light 22 into the cavity 14. One preferred such means would include hook and loop fastening bands, 26 and 28, with one of those bands, e.g. the hook bands 26, being fitted and anchored into the recess 20, while the other band, e.g. the loop bands 28, being anchored to the portion of the light interior face 22*b* in register with recess 20. The hooks from fastening band 26 should project slightly short of the exterior mouth of recess 20, so as not to hamper the seating of light 22 against floor 14*c*; while the loops from fastening band 28 should be long enough to compressingly engage the hooks from fastening band 26 upon full seating of the light housing interior face 22*b* against seat 14*c*, without the band 28 being too large so as to preclude the occurrence of loops becoming sandwiched between surfaces 22*b* and 14*c* and thus compromising the firm seating of the light 22. FIG. 2 shows the fastening bands 26 and 28 being interlocked by their hook and loop assembly; while FIG. 4 shows how the two fastening bands 26 and 28 are forcibly detached from one another by fingers F, F', pushing against light 22 outwardly from helmet 12.

Clearly, a number of different means equivalent to the hook and loop fastening means 26, 28, could be used to releasably secure the light housing 22 into the cavity 14, and these different means are therefore considered to be encompassed by the scope of the present invention.

Hence, it can now be readily understood that the safety helmet is of the streamlined, aerodynamically contoured type, to provide enhanced performance at high speeds. The aft lower end portion of the helmet external shell includes a cavity, this cavity receiving a light device with self-enclosed power pack. The light device is releasably anchored into the shell cavity by hook and loop fasteners. The light device is sized to substantially fully fill and complementarily fit inside the cavity in such a way that the exterior face of the light device becomes generally coextensive with the exterior face of the helmet contoured external shell, whereby the aerodynamic features of the helmet are not compromised. Access to the shell cavity from the shell interior face is enabled by two finger-engageable through-bores. The light device can be released from the shell cavity by pushing same with the cyclist's fingers through said through-bores.

I claim:

1. A safety helmet for a cyclist, including:

(a) a shell of arcuate exterior contour, at least the external part of said shell being a hard shell part, the interior part of said shell circumscribing an open enclosure to conformingly fit the head of the cyclist;

(b) a cavity being made into said hard external shell part, and defining a mouth opening exteriorly of said helmet, at least one through-bore being provided to extend through said shell and opening at its exterior end into said cavity and at its interior end into said shell interior open enclosure, said through-bore being diametrically smaller than said cavity and being sized for three through-engagement by a finger from the cyclist;

(c) a light member, releasably engaged into said cavity through said mouth, whereby said cyclist, upon removing his helmet from his head, can access with one finger the interior part of said light member inside said cavity and push said light member outwardly from said cavity; and (d) means for releasably anchoring said light member inside said cavity, the latter means being forcibly inactivated by such above-noted pushing action of said finger.

2. A safety helmet as defined in claim 1, wherein said hard external shell part is of aerodynamic design, and said light member filling substantially fully the volume of said cavity; and wherein said light member inside said cavity defines an exterior face which is substantially coextensive to and generally matches the radius of curvature of the arcuately contoured said hard external shell part.

3. A safety helmet as defined in claim 1, wherein said cavity defines an interior flat floor and said light member defines an interior flat wall, said means for releasably anchoring said light member inside said cavity consisting of a hook and loop fastener assembly including a first hook band and a second loop band, one of said bands being anchored to a recessed portion of said cavity interior flat floor while the other of said bands being anchored to a registering portion of said light member interior flat wall; whereby by seating said light member interior flat wall against said cavity interior floor, said hook and loop fastener assembly becomes operative.

4. A safety helmet as defined in claim 1, wherein said light member includes a self-enclosed power pack, said power pack being engaged and disengaged by a small on/off push-button projecting exteriorly therefrom, radially outwardly from said contoured shell external part.

5. A safety helmet as defined in claim 2, wherein said cavity defines an elongated, flat, interior floor, and said light member defines an interior flat wall, said means for releasably anchoring said light member inside said cavity consisting of a hook and loop fastener assembly including a first multiple hook band and a second multiple loop band, one of said bands being anchored to a recessed portion of said cavity interior floor while the other of said bands being anchored to a registering portion of said light member interior flat wall, whereby by seating said light member interior flat wall against said cavity interior floor, said hook and loop fastener assembly becomes operative; and further including a second through-bore, each said through-bore being diametrically smaller than said cavity and extending through said shell and opening at its exterior end into two opposite ends of said cavity elongated interior floor and at its interior end into said shell interior open enclosure, each said through-bore being sized for free through-engagement by a corresponding finger from the cyclist, said hook or loop fastening band anchored to said cavity interior floor extending between said through-bores short thereof; whereby said cyclist, upon removing his helmet from his head, can access with his two fingers the interior part of said light member inside said cavity and push said light member outwardly from said cavity, said hook and loop fastening bands automatically released from one another by such pushing action of said fingers.

6. A safety helmet as in claim 5, wherein said cavity is located at the lower aft portion of said helmet shell.

* * * * *